US009631447B2

(12) United States Patent
Larsen et al.

(10) Patent No.: US 9,631,447 B2
(45) Date of Patent: Apr. 25, 2017

(54) METHOD FOR REMOVAL OF CASINGS IN AN UNDERGROUND WELL

(71) Applicant: Well Techonology AS, Tananger (NO)

(72) Inventors: Arne Gunnar Larsen, Sandnes (NO); Patrick Andersen, Hafrsfjord (NO); Roy Inge Jensen, Stavanger (NO); Arnt Olav Dahl, Randaberg (NO); Morten Myhre, Tananger (NO)

(73) Assignee: Well Technology AS, Tananger (NO)

( * ) Notice: Subject to any disclaimer, the term of this patent is extended or adjusted under 35 U.S.C. 154(b) by 403 days.

(21) Appl. No.: 14/381,523

(22) PCT Filed: Mar. 4, 2013

(86) PCT No.: PCT/NO2013/050044

§ 371 (c)(1),
(2) Date: Aug. 27, 2014

(87) PCT Pub. No.: WO2013/133718

PCT Pub. Date: Sep. 12, 2013

(65) Prior Publication Data

US 2015/0047845 A1 Feb. 19, 2015

(30) Foreign Application Priority Data

Mar. 9, 2012 (NO) ..... 20120270

(51) Int. Cl.
*E21B 31/16* (2006.01)
*E21B 31/03* (2006.01)
*E21B 29/00* (2006.01)

(52) U.S. Cl.
CPC ..... *E21B 31/16* (2013.01); *E21B 29/002* (2013.01); *E21B 31/03* (2013.01)

(58) Field of Classification Search
CPC ..... E21B 31/16; E21B 31/03; E21B 31/12; E21B 31/00; E21B 31/20; E21B 23/00;
(Continued)

(56) References Cited

U.S. PATENT DOCUMENTS 4,047,568 A 9/1977 Aulenbacher
5,253,710 A 10/1993 Carter et al.
(Continued)

FOREIGN PATENT DOCUMENTS

WO 2011061506 5/2011

OTHER PUBLICATIONS

International Search Report and Written Opinion for PCT/N02013/050044 dated Jun. 25, 2013.
(Continued)

*Primary Examiner* — Wei Wang
(74) *Attorney, Agent, or Firm* — Andrus Intellectual Property Law, LLP

(57) ABSTRACT

A method is for removing casing from a well. The method includes setting a first sealing element into fluid-sealing engagement with the inside of the casing, lowering a flow-through string into the well, a cutting tool and a second, reversibly expandable sealing element being connected to the string, forming perforations into the casing by means of said cutting tool, expanding the second, expandable sealing element into fluid-sealing engagement with the inside of the casing, passing a pressurized fluid through the string and into the annulus via the perforations, so that the viscous and/or solid mass is displaced up the annulus, cutting the casing around its entire circumference; and pulling a length of the casing up from the well.

12 Claims, 15 Drawing Sheets

(58) Field of Classification Search
CPC ..... E21B 29/00; E21B 29/002; E21B 29/005; E21B 43/11
See application file for complete search history.

(56) References Cited

U.S. PATENT DOCUMENTS

2002/0060076 A1 5/2002 Harrell
2012/0312549 A1* 12/2012 Eddison ..... E21B 29/00 166/377

OTHER PUBLICATIONS

Abshire, Lucas W. et al., Offshore Permanent Well Abandonment, Oilfield Review, Spring 2012, p. 42-50, vol. 24, No. 1.
Ferg, Thomas E. et al., Novel Approach to More Effective Plug and Abandonment Cementing Techniques (Russian), SPE Arctic and Extreme Environments Conference and Exhibition, Oct. 18-20, 2011, p. 1, Society of Petroleum Engineers.

* cited by examiner

METHOD FOR REMOVAL OF CASINGS IN AN UNDERGROUND WELL

CROSS-REFERENCE TO RELATED APPLICATIONS

This application is the U.S. national stage application of International Application PCT/NO2013/050044, filed Mar. 4, 2013, which international application was published on Sep. 12, 2013, as International Publication WO2013/133718 in the English language. The international application is incorporated herein by reference, in entirety. The international application claims priority to Norwegian Patent Application No. 20120270, which is incorporated herein by reference.

FIELD

The invention relates to a method of removing casing in an underground well. More specifically, the invention relates to a method that enables the removal of longer portions of an inner casing in the well by the casing first being perforated, after which a fluid is forced out at high pressure via the perforations from the inside of the casing, so that old, viscous and/or settled-out drilling mud in the annulus around the casing is displaced by the pressurized fluid. The pressurized fluid has a lower specific weight than said viscous and/or settled-out drilling mud, so that the resistance/drag on the inner casing from the surrounding fluid is reduced, and a longer portion of the casing may thereby be removed in one lifting operation.

BACKGROUND

Often, in an underground well, several casings placed concentrically extend down the well from the opening of the wellbore to define and protect drilling and production equipment from the surrounding formations and vice versa. The lengths of the casings decrease with increasing diameters, so that the casing having the smallest diameter extends the farthest down the well. The outermost casing is generally cemented into the formation over the entire length of the pipe, whereas the rest of the casings are generally only cemented in a lower portion of the length of the casing from a guide shoe upwards in the annulus. The annuli between the different casings are generally, at least in an upper portion, filled by old, settled-out drilling mud of large mud weight.

In some cases, it may be desirable to remove a length of the innermost casing. This may be, for example, in connection with establishing a new well path. The viscous and/or settled-out drilling mud bring about drag on the casing so large that it will only be possible to remove shorter lengths, maybe only 5-10 meters, in each lifting operation, and it will therefore be very time-consuming and expensive to remove larger lengths of the casing.

SUMMARY

The invention has for its object to remedy or reduce at least one of the drawbacks of the prior art or at least provide a useful alternative to the prior art.

The object is achieved through features which are specified in the description below and in the claims that follow.

By depth in the well is meant, in what follows, the distance from the top of the well at the opening of the wellbore, so that a larger depth means increasing distance to the top.

The invention relates, more specifically, to a method of removing casing from a well, wherein an annulus between the outside of the casing and the inside of a surrounding downhole body is filled, at least partially, by a viscous and/or solid mass, and wherein the method includes the following steps:

(A) setting a first sealing element into fluid-tight engagement with the inside of the casing at a first depth in the well;

(B) lowering a string into the well, a cutting tool and a second, reversibly expandable sealing element being connected to the string, and the string being arranged to carry a fluid, characterized by the method further including the following steps:

(C) forming perforations into the casing by means of the cutting tool at a second depth in the well which is smaller than the first depth at which the first sealing element is set into fluid-sealing engagement;

(D) expanding the second, expandable sealing element into fluid-sealing engagement with the inside of the casing at a third depth in the well which is smaller than the second depth at which the perforations were formed, so that the perforations will be at a depth in the well between the first and second sealing elements;

(E) passing a fluid at high pressure through the string into the annulus via the perforations, so that the viscous and/or solid mass is displaced up the annulus, circulated out of the well and substantially replaced by the fluid, the fluid having a lower specific weight than the viscous and/or solid mass;

(F) cutting the casing around its entire circumference at a fourth depth, down to which the surrounding viscous and/or solid mass has substantially been replaced by the fluid; and (G) pulling a length of the casing up from the well.

Step C may include forming perforations in the casing without harming the integrity of a surrounding downhole body.

In a preferred embodiment, after step (E), the method may further include retracting the second, reversibly expandable sealing element into a non-expanded position, so that the fluid-sealing engagement with the inside of the casing ceases. This may be appropriate in order to be able to move the string deeper into the well.

In a further preferred embodiment, the method may include repeating the steps (C) to (E) in a cycle one or more time(s), at an increasing depth in the well for every repetition. This could be appropriate if a viscous and/or solid mass is to be displaced along a larger length of the casing, wherein it may be advantageous to displace and replace the viscous and/or solid mass in one length portion at a time.

In another preferred embodiment, after step (F), the method may further include expanding the second, reversibly expandable sealing element into engagement with the inside of the casing at a fifth depth in the well which is smaller than the fourth depth at which the casing has been cut around its entire circumference. This will have the advantage of enabling the casing to be pulled out of the well together with the string by means of a hoisting device of a kind known per se. Alternatively, the casing may be pulled out of the well in a separate operation independently of the string.

In one embodiment, the method may include cutting the casing around its entire circumference one or more time(s). This will entail the possibility for the length of casing, which is to be removed, to be retrieved from the well in two or more operations. This may be appropriate if a very long and/or heavy length of casing is to be removed from the well.

U) The cutting tool may be, for example, an abrasive tool, a chip-forming tool or a perforation gun of types known per se. The abrasive tool may be a sandblasting tool, for example.

The reversibly expandable sealing element may be a hydraulic sealing element of a type known per se.

The fluid which is passed through the string at high pressure may be drilling mud of a type known per se. The drilling mud may have had an abrasive medium added to it, for example sand.

The string may be a drill string or a coiled-tubing string of types known per se.

The annulus may be, for example, a so-called B-annulus between the innermost casing and a surrounding casing.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figure 1:
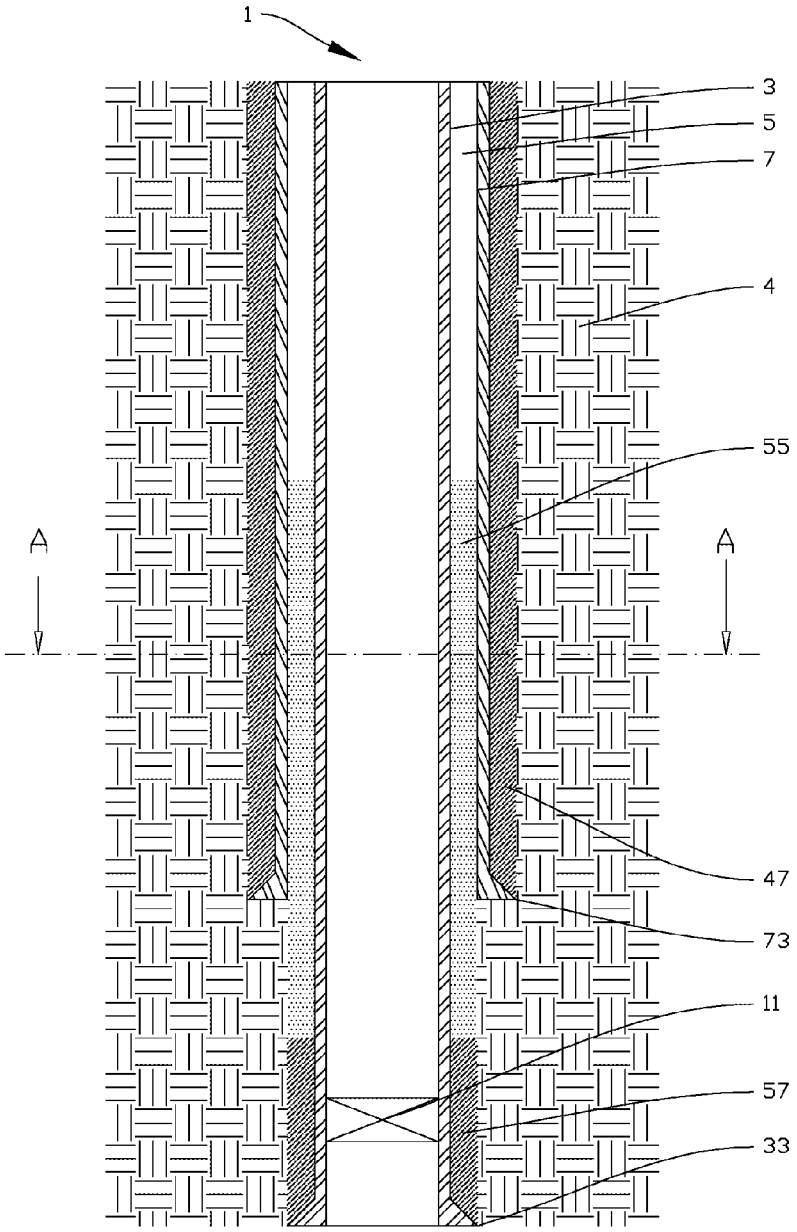
FIG. 1 shows a simplified sketch of a well in a side view.

In what follows, the reference numeral 1 indicates a well as used in the method of the present invention. The well 1 is shown in a schematic and simplified manner, and elements which are not central to the invention may have been left out of the figures. Two casings 3, 7 placed substantially concentrically extend from the opening of the wellbore and down into the well 1. The inner casing 3 extends further down the well 1 than the outer casing 7. In accordance with the present invention, the outer casing 7 may be an arbitrary downhole body which, at least in a portion, surrounds the inner casing 3. The outer casing 7 is set into the formation 4 by a foundation laid by means of cement 47 over the entire length of the casing 7 from the opening of the wellbore down to a guide shoe 73 at a lower portion of the outer casing 7. The inner casing 3 is set into the formation 4 by a foundation laid by means of cement 57 in a portion above a guide shoe 33 at a lower portion of the inner casing 3. An annulus 5 between the two casings 3, 7 is partially filled by a viscous and/or solid mass 55 which may be constituted, at least in part, by settled-out drilling mud. A first sealing element 11 has been set in fluid-tight engagement with the inside of the inner casing 3 at a first depth D1 in the well 1.

FIG. 1 shows the well 1 in a side view after the sealing element 11 has been set in the inner casing 3. The sealing element 11 may be a packer of a kind known per se.

Figure 2:
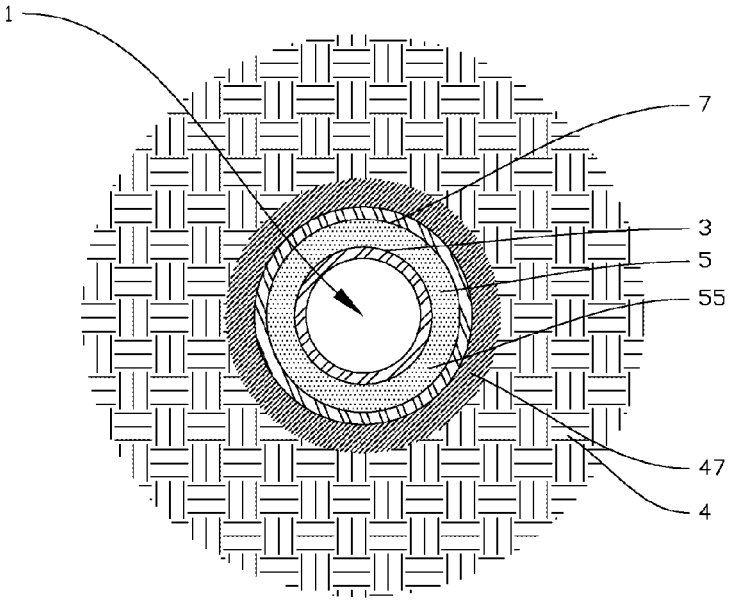
FIG. 2 shows a sketch of the well in a top view through the line A-A in FIG. 1.

FIG. 2 shows a section of the well 1 in a top view through the line A-A as indicated in FIG. 1.

Figure 3:
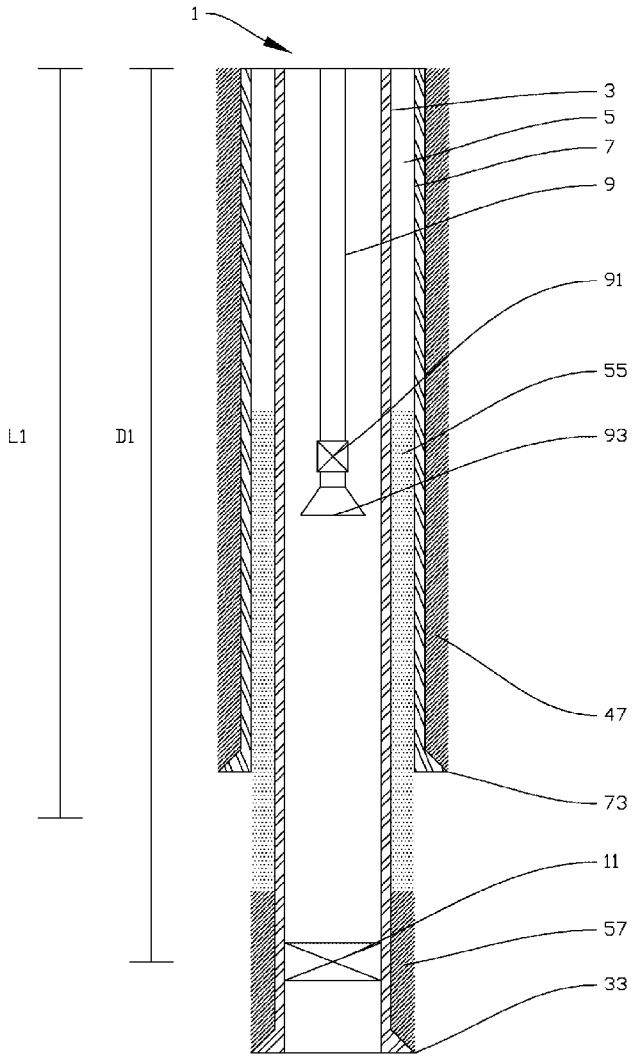
FIG. 3 shows a side view of the well after a fluid-carrying string has been lowered into the well.

FIG. 3 shows the well 1 after a fluid-carrying string 9 has been moved some distance into the well 1 through the Inner casing 3. The formation 4 is not shown in the FIGS. 3-14 for the sake of exposition. The first depth D1, at which the packer 11 is set in the inner casing 3, is larger than a length L1 of the casing 3 that is desirably to be removed. To the string 9, a cutting tool 93 and a reversibly expandable sealing element 91 are connected. The reversibly expandable sealing element 91 is arranged to be repeatedly expanded into fluid-sealing engagement with the inside of the casing 3 and retracted from the fluid-sealing engagement into a non-expanded position.

Figure 4:
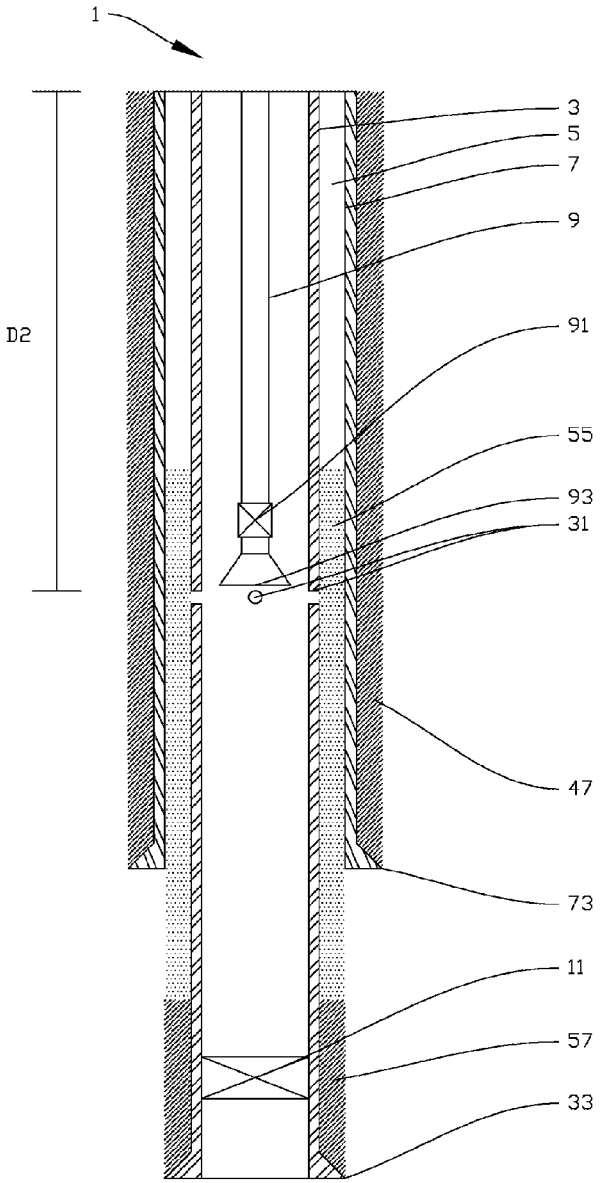
FIG. 4 shows a side view of the well after an inner casing has been perforated.
Figure 5:
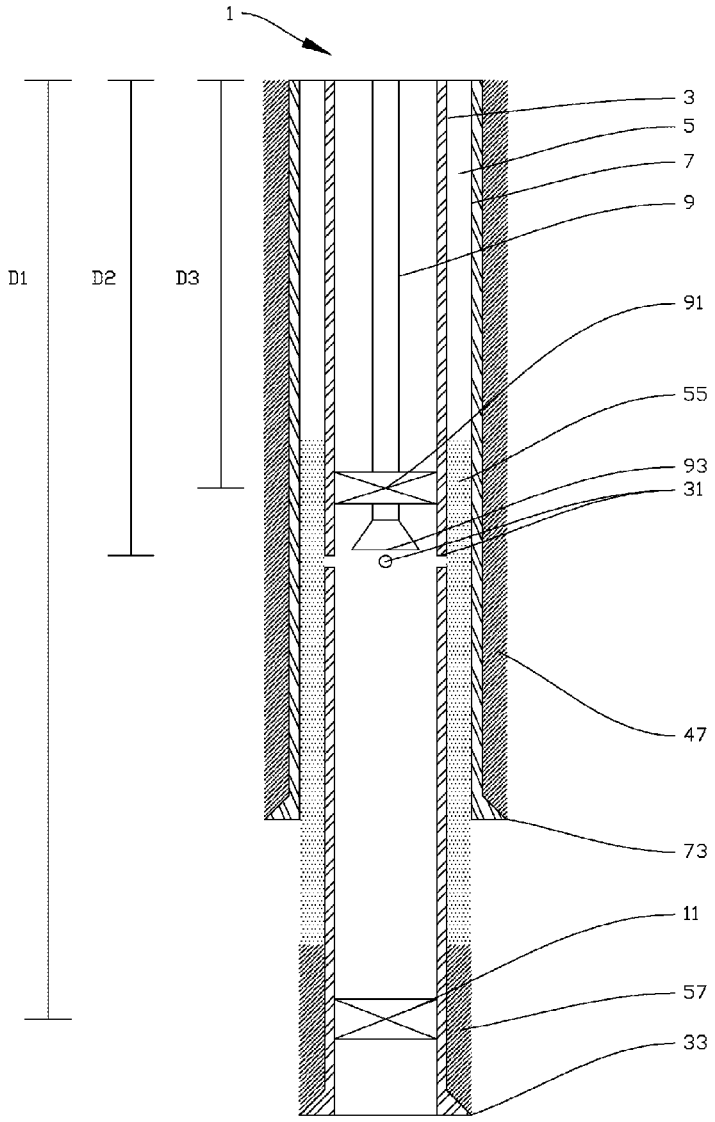
FIG. 5 shows a side view of the well after a reversibly expandable sealing element has been expanded into fluid-sealing engagement with the inside of the casing.
Figure 6:
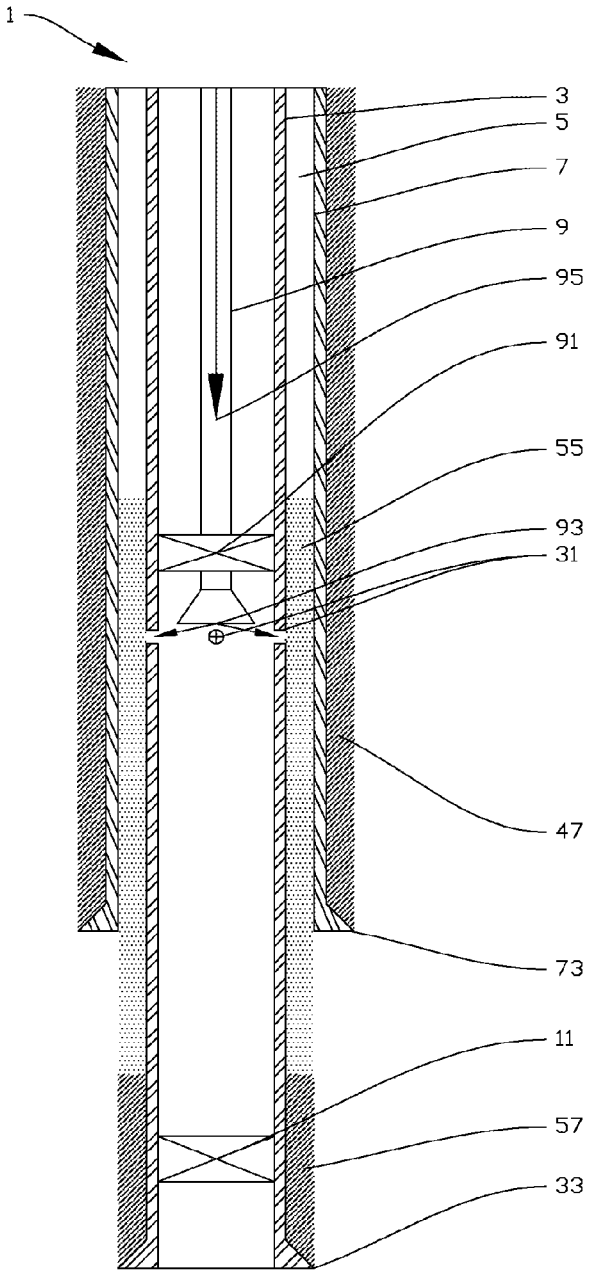
FIG. 6 shows a side view of the well while a fluid at high pressure is flowing through the string.
Figure 7:
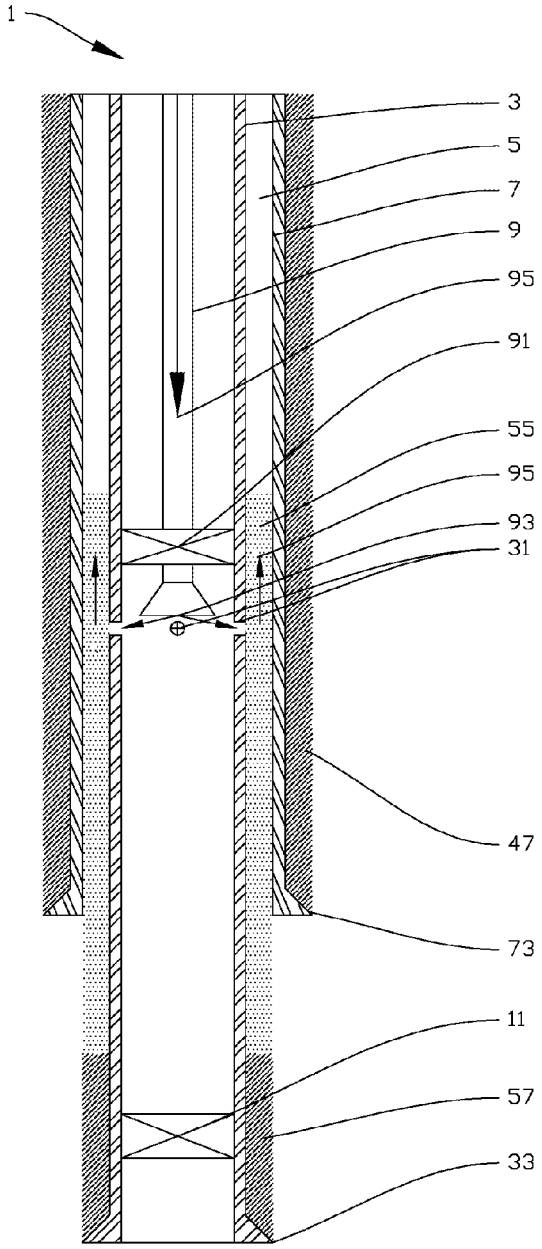
FIG. 7 shows a side view of the well while the fluid is forced into the annulus via the perforations.
Figure 8:
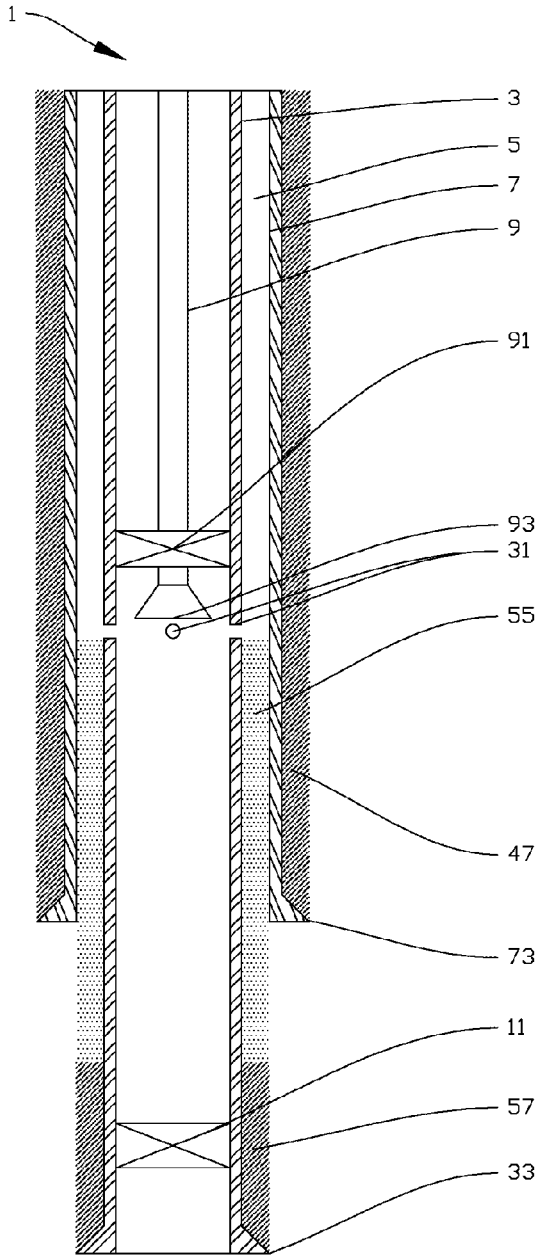
FIG. 8 shows a side view of the well after settled-out drilling mud in a portion of the annulus has been displaced by the fluid.

FIG. 4 shows the well 1 after the cutting tool 93 has been used to form perforations 31 in the inner casing 3 at a second depth D2 in the well 1. The reversibly expandable sealing element 91 is then expanded into fluid-sealing engagement with the inside of the inner casing 3 at a third depth D3 in the well so that D1>D2>D3, as shown in FIG. 5. After the reversibly expandable sealing element 91 has been set into fluid-sealing engagement with the inside of the inner casing 3, a fluid 95 is carried through the string 9 from a source not shown. The fluid 95, which may be drilling mud of a known type, for example, is indicated by arrows showing its direction of flow in FIG. 6. At sufficiently high pressure, the fluid 95 may be forced into the annulus 5 via the perforations 31 and the viscous and/or solid mass 55 is displaced upwards in the annulus 5 by the fluid 95 and is finally circulated out of the well 1 as shown in FIGS. 7 and 8. The viscous and/or solid mass 55 is thus replaced by the fluid 95 from the second depth D2 upwards within the annulus 5. The fluid 95 has a lower specific weight than the viscous and/or solid mass 55 and will thus give less resistance/drag as a length of the casing 3 is being removed from the well 1. The fluid 95 is only indicated in the figures (as arrows) when it is flowing, but is otherwise not shown for the sake of exposition.

Figure 9:
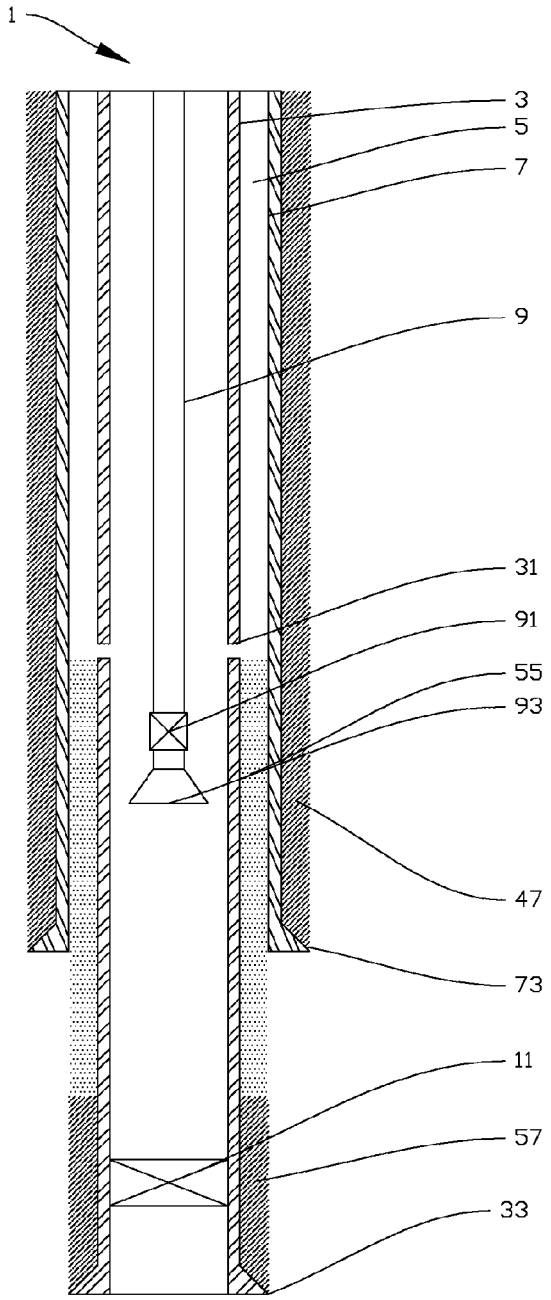
FIG. 9 shows a side view of the well after the reversibly expandable sealing element has been retracted and the string has been moved deeper into the well.

After the operation of displacing the viscous and/or solid mas 55 has been carried out once, the reversibly expandable sealing element 91 is retracted into its non-expanded position (not shown) so that the fluid-sealing engagement with the inside of the Inner casing 3 ceases. The string 9, with the cutting tool 93 and the non-expanded reversibly expandable sealing element 91 connected to it, is then moved further down the well 1 to repeat the operation of displacing viscous and/or solid mass 55 from the annulus 5, as shown in FIG. 9.

Figure 10:
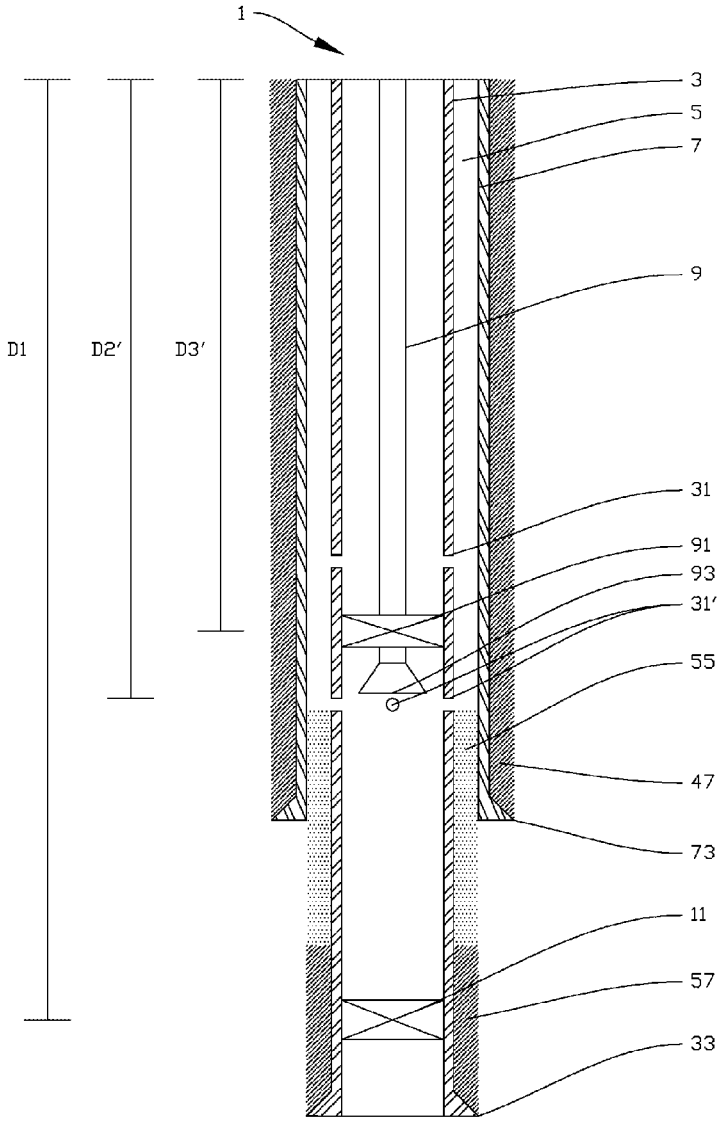
FIG. 10 shows a side view of the well after the inner casing has been perforated at a larger depth, the expandable sealing element has been expanded into engagement with the casing again and new settled-out drilling mud has been displaced from the annulus.

In FIG. 10, the well 1 is shown after the cutting tool 93 has formed new perforations 31' at a depth D2' in the well, the reversibly expandable sealing element 91 has been expanded into fluid-sealing engagement with the inside of the casing 3 at a depth D3', wherein D1>D2'>D3', and after the viscous and/or solid mass 55 has been displaced from the annulus 5 in the portion between the depths D2 and D2', wherein D2'>D2.

Figure 11:
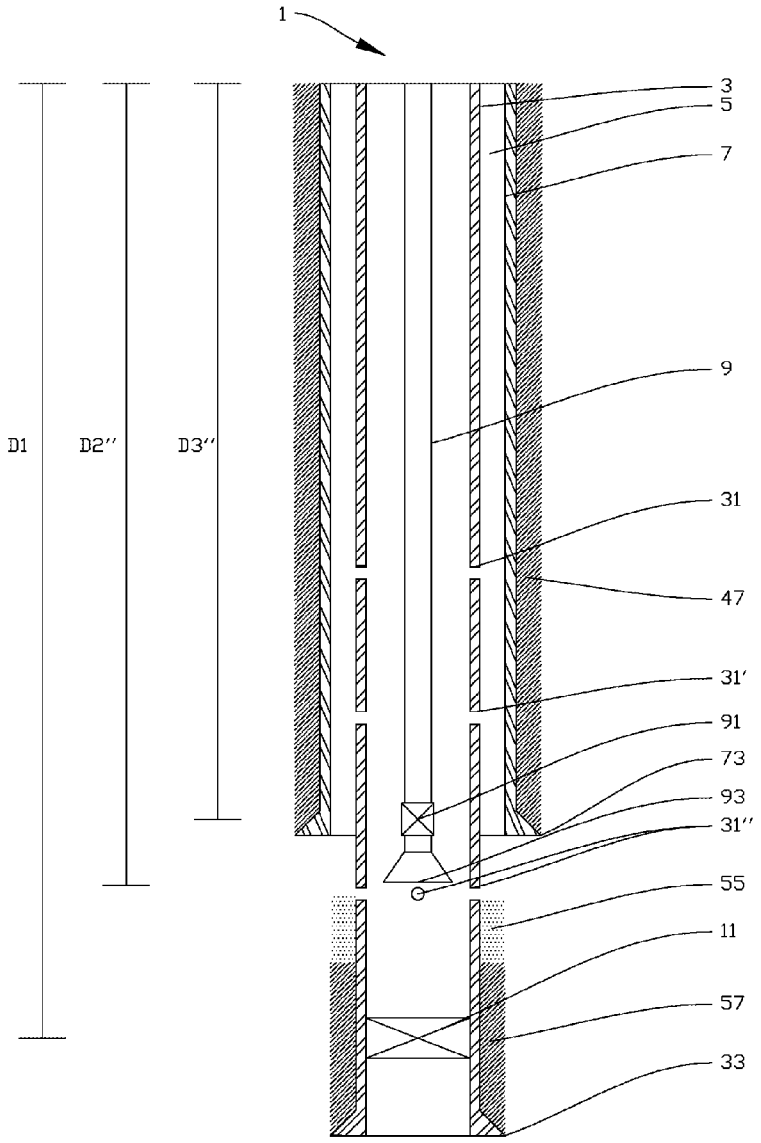
FIG. 11 shows a side view of the well after further perforations have been formed in the Inner casing.

In FIG. 11, the well 1 is shown after the above-mentioned operation has been repeated a third time with perforations 31" at a depth D2", expansion of the reversibly expandable sealing element at a depth D3", wherein D1>D2">D3", and displacement of a viscous and/or solid mass 55 in the annulus 5 between the depths D2' and D2", wherein D2">D2'. The well 1 is shown after the reversibly expandable sealing element 91 has been retracted into its non-expanded position so that its fluid-sealing engagement with the inside of the casing 3 has ceased.

Figure 12:
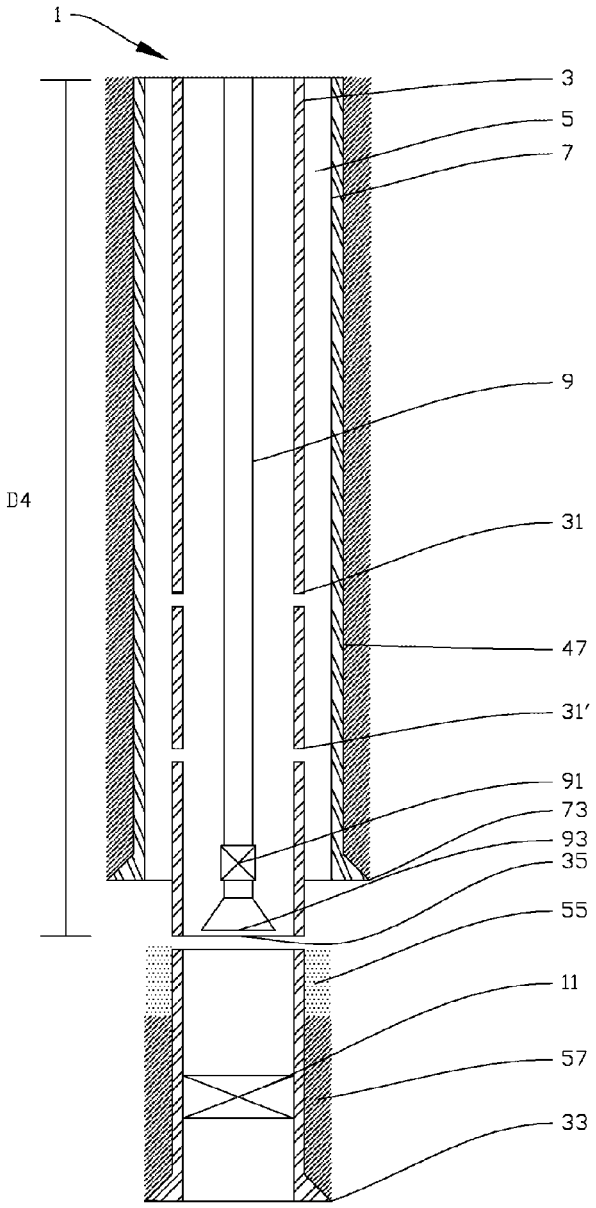
FIG. 12 shows a side view of the well after the inner casing has been cut around its entire circumference.

In FIG. 12, the well 1 is shown after the cutting tool 93 has been used to form a cut 35 around the circumference of the casing 3 at a fourth depth D4 so that a length L1 of the casing 3 is released and may thereby be pulled out of the well 1. The length L1 is shown in the figures as corresponding to the depth D2" and the fourth depth D4 but, in alternative embodiments, they may be different.

Figure 13:
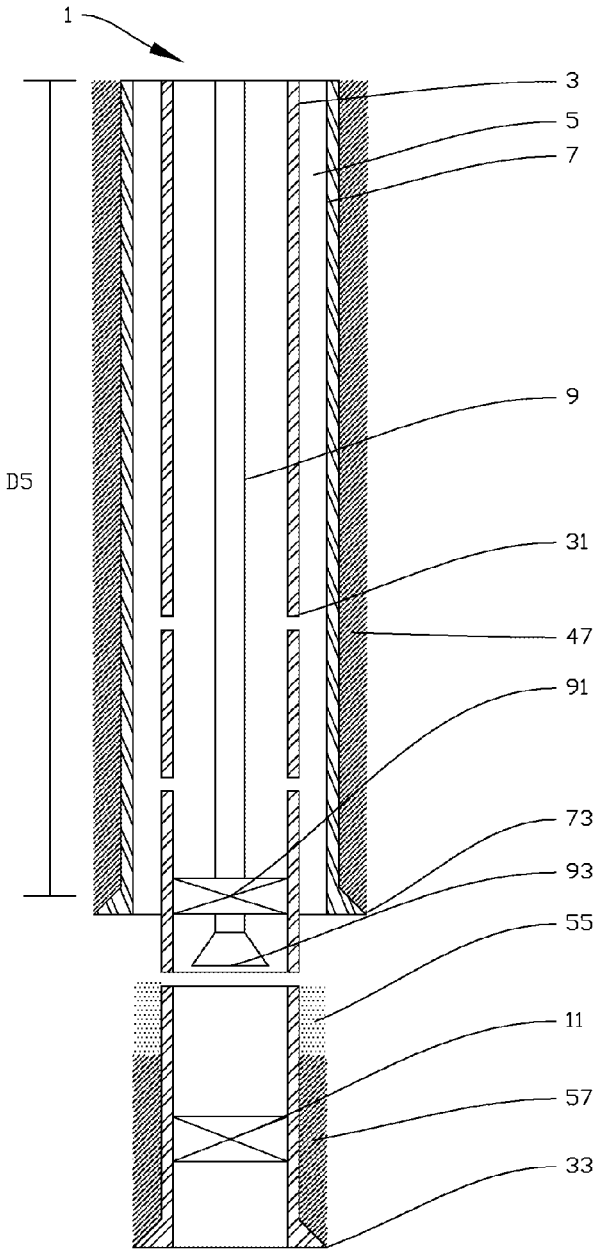
FIG. 13 shows a side view of the well after the reversibly expandable sealing element has been expanded again into engagement with the inner casing.

The reversibly expandable sealing element 91 is then expanded into new engagement with the inside of the casing 3 at a fifth depth D5 in the well 1, as shown in FIG. 13, the fifth depth D5 being shallower than the fourth depth D4 at which the inner casing 3 has been cut around its circumference, so that D4>D5. In the figures, D5=D3" but in alternative embodiments, they may be different. In an alternative embodiment, the reversibly expandable sealing element 91 may remain expanded at the depth D3" after the viscous and/or solid mass 55 has been circulated out of the annulus 5 between D2' and D2", so that cutting of the inner casing 3 around its circumference by means of the cutting tool 93 is performed while the reversibly expandable sealing element 91 is expanded.

Figure 14:
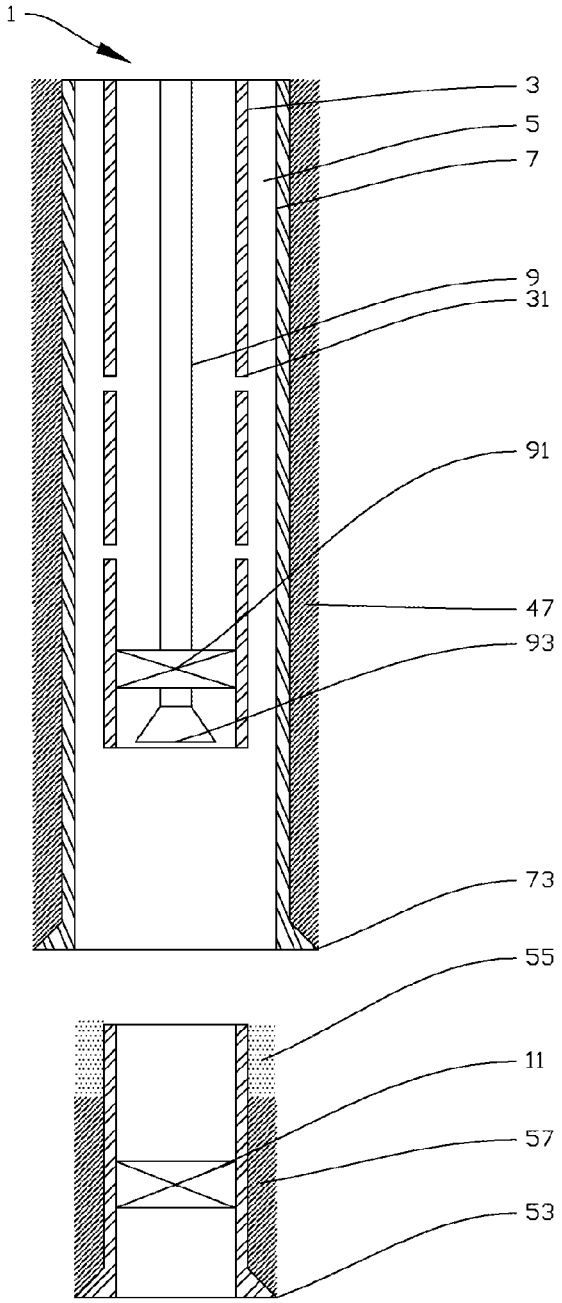
FIG. 14 shows a side view of the well after the inner casing has been pulled partly out of the well.

FIG. 14 shows the well 1 while the length L1 of the inner casing 3 is in the process of being pulled out of the well 1 together with the string 9 by means of a hoisting device, not shown, of a kind known per se. The engagement between the reversibly expandable sealing element 91 in its expanded position and the inside of the inner casing 3 is strong enough for the length L1 of the inner casing 3 to follow the string 9 out of the well 1. Alternatively, the inner casing 3 could be cut around its circumference at two places or more, so that smaller lengths of the casing 3 could be hoisted out of the well 1 together with the string 9. The latter cutting of the casing 3 in two or more places would then require more trips into the well 1 for the entire length L1 of the inner casing 3 to be retrieved.

Figure 15:
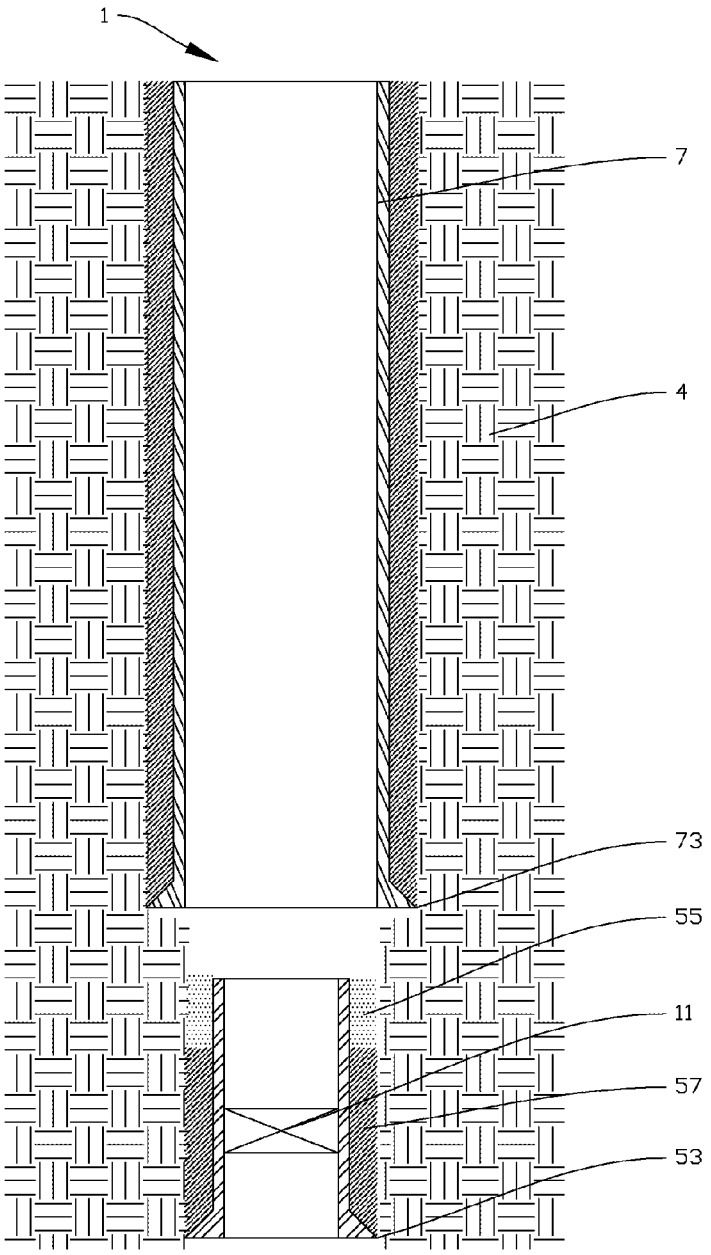
FIG. 15 shows a side view of the well after the inner casing has been pulled out of the well.

FIG. 15 shows the well 1 after the length L1 of the inner casing 3 has been retrieved and the well 1 has been prepared for forming a new well path, for example.

The invention claimed is:

1. A method of removing casing from a well, in which an annulus between the outside of the casing and the inside of a surrounding downhole body is at least partially filled by a viscous and/or solid mass, the method comprising:

(A) setting a first sealing element into fluid-sealing engagement with the inside of the casing at a first depth in the well;

(B) lowering a string into the well, a cutting tool and a second, reversibly expandable sealing element being connected to the string, and the string being arranged to carry a fluid;

(C) forming perforations into the casing with said cutting tool at a second depth in the well which is smaller than the first depth at which the first sealing element is set into fluid-sealing engagement;

(D) expanding the second, expandable sealing element into fluid-sealing engagement with the inside of the casing at a third depth in the well which is smaller than the second depth at which the perforations were formed, so that the perforations will be located between the first and second sealing elements in the well;

(E) passing the fluid at high pressure through the string and into the annulus via the perforations so that the viscous and/or solid mass is displaced up the annulus, circulated out of the well and substantially replaced by the fluid, the fluid having a lower specific weight than the viscous and/or solid mass;

(F) cutting the casing around its entire circumference at a fourth depth, down to which the surrounding viscous and/or solid mass has substantially been replaced by the fluid; and (G) pulling a length of the casing up from the well.

2. The method in accordance with claim 1, wherein, after (E), the method further includes retracting the second, reversibly expandable sealing element into a non-expanded position, so that the fluid-sealing engagement with the inside of the casing ceases.

3. The method in accordance with claim 2, wherein the method further includes repeating (C) to (E) in a cycle one or more time(s), at an increasing depth in the well for every repetition.

4. The method in accordance with claim 1, wherein, after (F), the method further includes expanding the second, reversibly expandable sealing element into engagement with the inside of the casing at a fifth depth in the well which is smaller than the fourth depth at which the casing has been cut around its entire circumference, so that the inner casing may be pulled out of the well together with the string.

5. The method in accordance with claim 1, wherein the method includes cutting the casing around its entire circumference one or more time(s) so that the length of the casing to be removed may be retrieved from the well in two or more operations.

6. The method in accordance with claim 1, wherein the cutting tool is an abrasive tool.

7. The method in accordance with claim 6, wherein the abrasive tool is a sandblasting tool.

8. The method in accordance with claim 1, wherein the second, reversibly expandable sealing element is a hydraulic sealing element.

9. The method in accordance with claim 1, wherein the pressurized fluid is drilling mud.

10. The method in accordance with claim 1, wherein the string is a drill string.

11. The method in accordance with claim 1, wherein the string is a coiled-tubing string.

12. The method in accordance with claim 1, wherein the annulus is a so-called B-annulus located between an innermost casing and a surrounding casing.

* * * * *